US007670119B2

(12) United States Patent
Durand et al.

(10) Patent No.: US 7,670,119 B2
(45) Date of Patent: Mar. 2, 2010

(54) MULTISTAGE VACUUM PUMP AND A PUMPING INSTALLATION INCLUDING SUCH A PUMP

(75) Inventors: Pascal Durand, La Balme de Sillingy (FR); Jean-François Vuillermoz, Annecy le Vieux (FR); Patrick Pilotti, Cran-Gevrier (FR); Jean-François Grosdaillon, Mures (FR)

(73) Assignee: ALCATEL, Paris (FR)

( * ) Notice: Subject to any disclaimer, the term of this patent is extended or adjusted under 35 U.S.C. 154(b) by 1070 days.

(21) Appl. No.: 11/109,798

(22) Filed: Apr. 20, 2005

(65) Prior Publication Data

US 2005/0238502 A1 Oct. 27, 2005

(30) Foreign Application Priority Data

Apr. 21, 2004 (FR) ..... 04 50741

(51) Int. Cl.
*F04C 2/00* (2006.01)
*F04C 23/00* (2006.01)

(52) U.S. Cl. ..... 418/13; 418/259; 418/268

(58) Field of Classification Search ..... 418/5, 418/13, 259, 268
See application file for complete search history.

(56) References Cited

U.S. PATENT DOCUMENTS

| | | | | | |
|---|---|---|---|---|---|
| 3,116,872 | A | * | 1/1964 | Zinsmeister et. al. | 418/13 |
| 3,668,393 | A | | 6/1972 | Rauch | |
| 5,733,104 | A | | 3/1998 | Conrad et al. | |

FOREIGN PATENT DOCUMENTS

| | | | | | |
|---|---|---|---|---|---|
| DE | 37 10 782 | A | | 10/1988 | |
| DE | 101 50 015 | A | | 4/2003 | |
| GB | 863 163 | A | | 3/1961 | |
| JP | 52037214 | A | * | 3/1977 | 418/9 |
| JP | 62023501 | A | * | 1/1987 | 418/9 |
| JP | 03271578 | A | * | 12/1991 | 418/13 |
| JP | 04036091 | A | * | 2/1992 | 418/13 |

* cited by examiner

*Primary Examiner*—Theresa Trieu
(74) *Attorney, Agent, or Firm*—Sughrue Mion, PLLC

(57) ABSTRACT

The present invention provides a multistage vacuum pump comprising at least a low pressure first stage and at least a high pressure second stage. At least one of the stages has at least one suction inlet for admitting gas to be pumped, and at least one of the stages has at least one delivery outlet that is open to the outside for exhausting pumped gas. The first and second stages communicate with each other in order to pass gas from the first stage to the second stage. The first stage operates at a flow rate that is smaller than that of the second stage. For an oil-seal rotary vane positive-displacement pump, the oil is injected into the stage having the greater flow rate.

14 Claims, 2 Drawing Sheets

MULTISTAGE VACUUM PUMP AND A PUMPING INSTALLATION INCLUDING SUCH A PUMP

This application is based on and claims the benefit of French patent application No. 04/50 741, filed Apr. 21, 2004, which is incorporated herein by reference.

BACKGROUND OF THE INVENTION

1.Field of the Invention

The present invention relates to a multistage vacuum pump. It also extends to a pumping installation including such a pump.

2.Description of the Related Art

A vacuum pump is a device capable of extracting and exhausting molecules of gas so as to lower the pressure inside a chamber. A "rough" vacuum is defined as pressures greater than about 1 millibar (mbar). Under such circumstances, a so-called "primary" pump is used, such as a vane pump. A "medium" vacuum corresponds to pressures lying in the range 1 mbar to $10^{-3}$ mbar. A "high" vacuum relates to pressures less than about $10^{-3}$ mbar and down to about $10^{-7}$ mbar, beyond which the vacuum is said to be "ultrahigh". If it is desired to obtain a high vacuum in an installation, a primary pump has a secondary pump coupled thereto, e.g. a turbomolecular pump.

When a plurality of pumping stages of the same type are coupled together in series in the same pump, the pump is said to be multistage pump. For example, a two-stage vacuum pump that is in widespread use has two stages. The first stage in the flow direction, or suction stage (commonly referred to as the "low pressure" stage since this is the stage in which the lowest pressure is generated) is of large size so as to maximize pumping flow rate. The second stage in the flow direction, or delivery stage (commonly called the "high pressure" stage since this is the stage that operates at the highest pressure) is generally of smaller size, with a lower flow rate.

The invention relates in particular to an installation having at least two chambers requiring different vacuum levels and each connected to a pump unit. The presence of a plurality of pumps having different characteristics in such an installation turns out to be particularly costly in terms of investment, maintenance, and energy consumption. There is thus a need for an installation requiring a small number of pumps for equivalent performance and at a cost that is lower than that of presently known installations.

By way of example, document U.S. Pat. No. 5,733,104 describes an installation comprising four chambers in succession in which a vacuum is required. The last three chambers are connected to a secondary pumping unit comprising two turbomolecular stages and a molecular stage. The two turbomolecular stages have their admission inlets respectively connected to the last two chambers of the installation, the second stage also being connected to the outlet of the first stage. The molecular stage is connected to the outlet of the second turbomolecular stage and possesses an admission inlet connected to the third chamber. These stages have their rotors driven by a common transmission shaft, itself driven by a single motor and a single control member. The first chamber is connected to a dry primary pump such as a diaphragm pump. The dry primary pump is installed in series with the secondary pumping unit and is connected via its suction inlet to the outlet of the molecular stage. A duct for pumping the first chamber is connected to the same inlet.

That solution suffers from the drawback that only one flow is possible compatible with the limited flow rate of the diaphragm pump. In addition, it can be operated only with stable pressure ratios from one chamber to another, even if the compression ratio of the molecular portion and the presence of the cold trap for compressible vapors make it possible to interrupt the operation of the diaphragm pump in order to extend the lifetime of the diaphragm.

Document U.S. Pat. No. 3,668,393 shows an installation, e.g. an electron microscope, comprising firstly an enclosure in which a high level of vacuum is required, and secondly additional compartments that are evacuated. The installation also has a pumping group comprising a turbomolecular arrangement and a two-stage primary pump. The turbomolecular arrangement comprises a main stage connected to the enclosure and an auxiliary stage connected to the additional compartment. Both stages are contained in a common housing and are connected via a common transmission shaft to a single motor; nevertheless a relatively leaktight partition separates the outlets from the two pumps which do not communicate with each other, each being delivered to a different stage of the associated pump. The primary pump comprises a high pressure stage whose admission inlet is connected to the outlet of the main pump of the turbomolecular arrangement and whose delivery outlet continuously delivers gas to the low pressure stage of the primary pump. The low pressure stage is then connected to the high pressure stage via a transfer channel to which the outlet of the auxiliary pump is connected via a valve. The flow from the low pressure stage of the primary pump is mixed with the flow coming from the auxiliary turbomolecular pump at the high pressure stage thereof so that the gases pumped via those two paths can subsequently be exhausted to the outside.

Such an installation makes it possible simultaneously to have two different levels of vacuum in two distinct spaces while using a single conventional two-stage primary pump and an arrangement further including two secondary pumps.

That solution suffers from the drawback of there being a high degree of interdependence between the vacuum levels and the flows obtained through each orifice of the vane pump. The system thus operates only with small pressure variations in the auxiliary pumping system, thus limiting its use to well-defined experimental conditions.

SUMMARY OF THE INVENTION

An object of the present invention is to improve prior art installations by proposing a multistage vacuum pump suitable for simultaneously acting as a primary pump to obtain a rough vacuum in one chamber and to maintain a vacuum at a lower pressure, e.g. at the outlet from a secondary pump.

The present invention thus provides a multistage vacuum pump comprising at least a low pressure first stage and at least a high pressure second stage, at least one of said stages having at least one inlet for admitting gas to be pumped (commonly referred to as the "suction inlet"), and at least one of said stages having at least one outlet open to the outside for exhausting the pumped gases (commonly referred to as the "delivery outlet"), said first and second stages communicating to pass gas from said first stage to said second stage, the pump being characterized in that said first stage operates at a flow rate lower than said second stage.

The solution thus consists in particular in interchanging the respective flow rates of the low pressure and high pressure stages compared with presently known pumps. Thus, the first stage has a swept volume per cycle that is less than that of the second stage. The term "swept volume per cycle" is used to designate that part of the flow rate of the pump that depends on the volume of its components, given that flow rate varies both with the volume transferred per revolution (geometrical dimensions of the components) and with the speed of rotation. When the stages are on the same transmission shaft, the speeds of rotation are equal, and for given diameter, greater length represents increasing swept volume per cycle, or conversely equal lengths with different diameters can lead to different flow rates. In the present invention, a low pressure first stage is used having a small flow rate, e.g. for sucking in the gas coming from the outlet of a secondary pump, and a high pressure second stage is used having a flow rate that is greater and that has a gas inlet, e.g. for sucking in the gas coming from a chamber requiring a coarse vacuum, such as a chamber for use when loading an installation (or "load lock").

In a first embodiment of the invention, the first and second stages are physically interchanged, and as a result their flow rates are modified in this way. The first or "low pressure" stage thus has a swept volume per cycle that is reduced so that it is more particularly for pumping in the outlet from the secondary pump. The second stage or outlet stage has its swept volume per cycle increased, and can thus be used for sucking in at a high flow rate via an additional admission inlet.

The invention applies in particular to positive displacement pumps. In a positive displacement pump, a volume filled with gas is isolated cyclically from its admission point and transferred to a delivery point after a compression operation. To increase the volume flow rate of a pump, for other dimensions remaining equal, it is necessary to increase the volume swept on each pump cycle or to increase the speed of rotation of the pump. Naturally, this does not apply to pumps with small swept flow rate for which the stages can be of the same size.

Amongst positive displacement vacuum pumps, rotary pumps with lubricated vanes, known as "oil-seal" pumps are multistage pumps and are presently in industrial use. They have a supply of liquid oil in the form of a vessel which generally surrounds the functional portion of the pump, the pump stages, and a device for introducing oil into the compression chamber. The functions required of such oil are numerous: in addition to its usual role as a lubricant, it evacuates the compression heat from the pump, it minimizes dead volumes, and it constitutes a seal between mechanical parts that are in relative motion. Without the oil seal, internal leaks at each stage would be much higher, and the compression ratio would be reduced accordingly. By using oil to seal the moving parts, it is possible to obtain a single stage with a maximum compression ratio of 105. It is necessary to minimize leakage rates in order to achieve a low limit pressure.

A prior art vane pump is conventionally fitted with an inlet for sucking in gas molecules from the outside that is situated at the "low pressure" stage. The "high pressure" stage has its suction inlet connected to the delivery outlet of the "low pressure" stage and has an outlet for exhausting the delivered compressed gas to the outside. The high pressure stage is also defined as being the stage into which oil is introduced from the vessel which is maintained at a pressure close to atmospheric. The oil which is in regular contact with the outside atmosphere absorbs air, and on being introduced into the "high pressure" stage, the air is released into the volume at lower pressure. Some of the air is removed again during the delivery cycle, while some of it migrates in part in the form of an internal leak towards the suction of the "high pressure" stage. In two-stage oil-seal pumps, the "low pressure" stage is fed from the "high pressure" stage with oil that has already been degassed in the "high pressure" stage. The suction pressure then lies in the high vacuum range of values and the lowest working pressures lie at the boundary between the medium vacuum and the high vacuum ranges.

In a second embodiment of the invention, the stages preferably conserve the traditional position existing on prior art pumps, but the functions of the stages are interchanged. Oil is injected into the second stage, i.e. the stage having the higher flow rate. The second stage is thus the "high pressure" stage. The degassed oil then passes from the high flow rate stage to the lower flow rate stage or "low pressure" stage. At the outlet from this "low pressure" stage, the transfer channel is modified accordingly to transfer the gas to the inlet of the "high pressure" stage. This solution provides the advantage of conserving the same disposition for the stages of the pump as before, i.e. with dimensions and implementation costs that are similar.

An advantage of the invention is that during use of the "low pressure" stage with a continuous low pressure flow, such as the outlet delivered by a turbomolecular pump, for example, the delivery pressure from the "low pressure" stage is lower than it would be in a prior art pump. Since the "high pressure" stage has greater displacement, the flow delivered by the "low pressure" stage is released into a larger volume and thus at a lower pressure. When cyclically pumping an air lock via the "high pressure" stage, since the volume of the stage and its displacement are greater, the rise in pressure is smaller and the time required for lowering the pressure is likewise shorter. It should be observed that during the cyclical rises in pressure, the vanes of the "low pressure" stage at act as "check valves" against the suction pressure of the "low pressure" stage. The vanes and the reduction in the magnitude and the duration of the pressure drop of the "high pressure" stage thus limit the rise of pressure towards the outlet of the secondary pump. This is particularly advantageous when pumping small to medium air lock volumes from atmospheric pressure by means of a high flow rate "high pressure" stage in cyclical applications of the "load lock" type.

The invention may also be applied to other types of positive displacement vacuum pump such as a diaphragm pump, a rotary piston pump, or an oscillating piston pump. It may also be applied to a dynamic compression pump such as a multistage dry pump of the Roots type. Under such circumstances the lubrication problem no longer arises. Under such circumstances it is the first embodiment of the invention that is used, i.e. interchanging the stages.

The present invention also provides a vacuum installation including such a multistage pump and further comprising at least one turbomolecular pump whose delivery outlet is connected to the multistage pump.

The installation preferably has at least two chambers. A first chamber is connected to the multistage pump of the invention, and a second chamber is connected to a turbomolecular pump whose delivery outlet is connected to the multistage pump. More precisely, the gas inlet of the low flow rate first stage is connected to the outlet from the turbomolecular pump, and the gas inlet of the greater flow rate second stage is directly connected to the first chamber.

Amongst numerous applications of the invention, mention can be made of mass spectrometer devices with continuous flow insertion, and applications of replicating CDs or DVDs. Mass spectrometer devices have an admission chamber at rough vacuum pressure and also chambers requiring a high vacuum that are fitted with secondary pumps. Applications relating to replication of CDs and DVDs have process chambers that are almost continuously under a high vacuum in which pressure is much less than 1 mbar, and substrate transfer and loading chambers (or load locks) which pass cyclically from atmospheric pressure to a medium vacuum of the order of a few mbar.

BRIEF DESCRIPTION OF THE DRAWINGS

Other characteristics and advantages of the present invention appear on reading the following description of an embodiment that is naturally given by way of non-limiting illustration, and from the accompanying drawings, in which.

DETAILED DESCRIPTION OF EXEMPLARY EMBODIMENTS OF THE INVENTION

Figure 1:
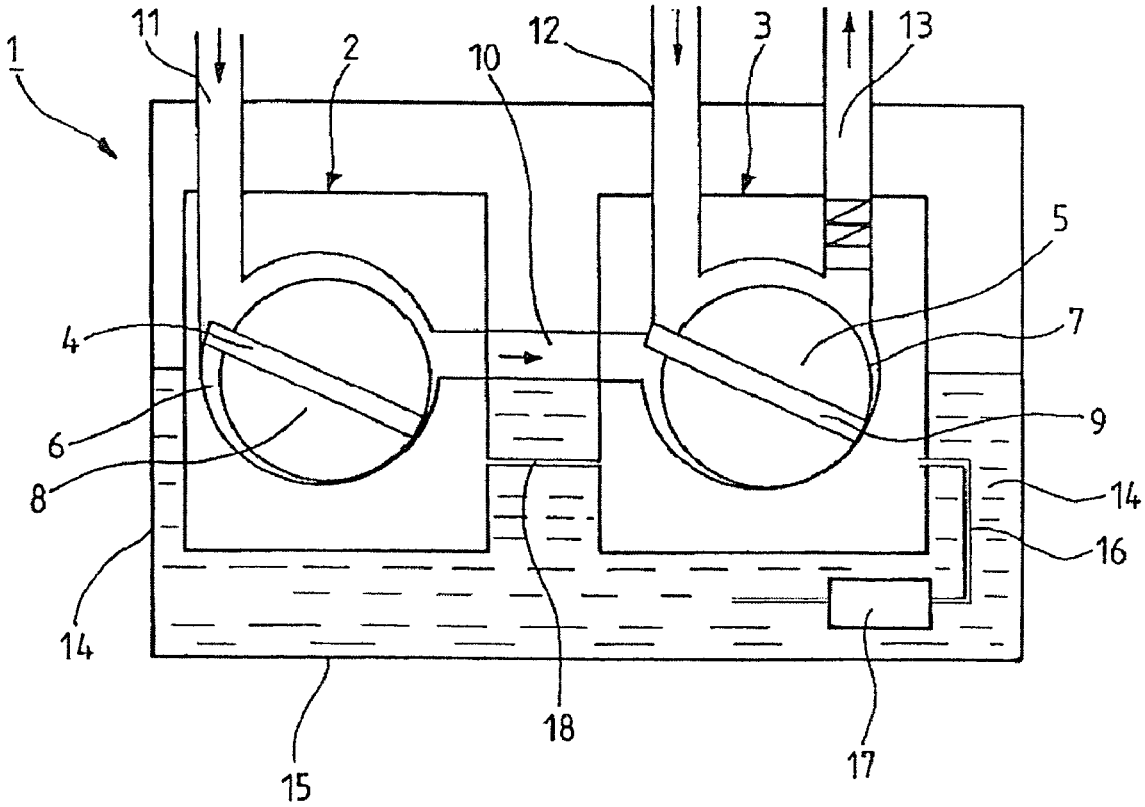
FIG. 1 is a diagrammatic section of a two-stage rotary positive displacement vacuum pump of the invention.

FIG. 1 shows a two-stage rotary positive displacement vacuum pump 1 with lubricated vanes in accordance with the invention. In conventional manner, the pump 1 comprises a "low pressure" first stage 2 which extracts gas molecules from an enclosure in which a vacuum is required, and it compresses them prior to sending them to a "high pressure" second stage 3 in which the gas molecules are compressed to a higher pressure prior to being expelled to the outside. The stages 2 and 3 are of analogous structure, each comprising a rotor 8, 5 secured to a shaft for transmitting mechanical energy delivered by a motor (not shown) and externally presenting a cylindrical surface having a generator line parallel to the axis of the shaft. The rotor 8, 5 is mounted eccentrically and tangentially inside a stator 6, 7. It has vanes 4, 9 perpendicular to the axis of the rotor 8, 5 and mounted to slide in a slot in the rotor 8, 5 perpendicularly to its axis. The stages 2 and 3 communicate via a tube 10 which allows gas molecules that have been compressed in the "low pressure" stage 2 to pass into the "high pressure" stage 3.

According to the invention, the "low pressure" stage 2 of smaller flow rate has an inlet 11 for admitting the gas to be sucked in, e.g. coming from the delivery of a secondary pump and an outlet connected to tube 10. The "high pressure" stage 3 having a greater flow rate has an inlet 12 for admitting the gas to be sucked in, e.g. form a load lock chamber, an inlet connected to tube 10 and an outlet 13 enabling gas that is to be exhausted to be delivered to the outside. Each stage may further have openings that are provided with exhaust valves (not shown).

The rotor and stator assembly 6 and 8 and 5 and 7 of each stage is placed in a vessel 14 filled with oil and acting as a tank 15. Liquid oil is contained in the tank 15 and is introduced into the "high pressure" stage 3 via a tube 16. Oil circulation can be natural, or it can be forced by an oil pump 17. During an operating cycle, oil is transferred from the "high pressure" stage 3 to the "low pressure" stage 2 via a passage 18.

Figure 2:
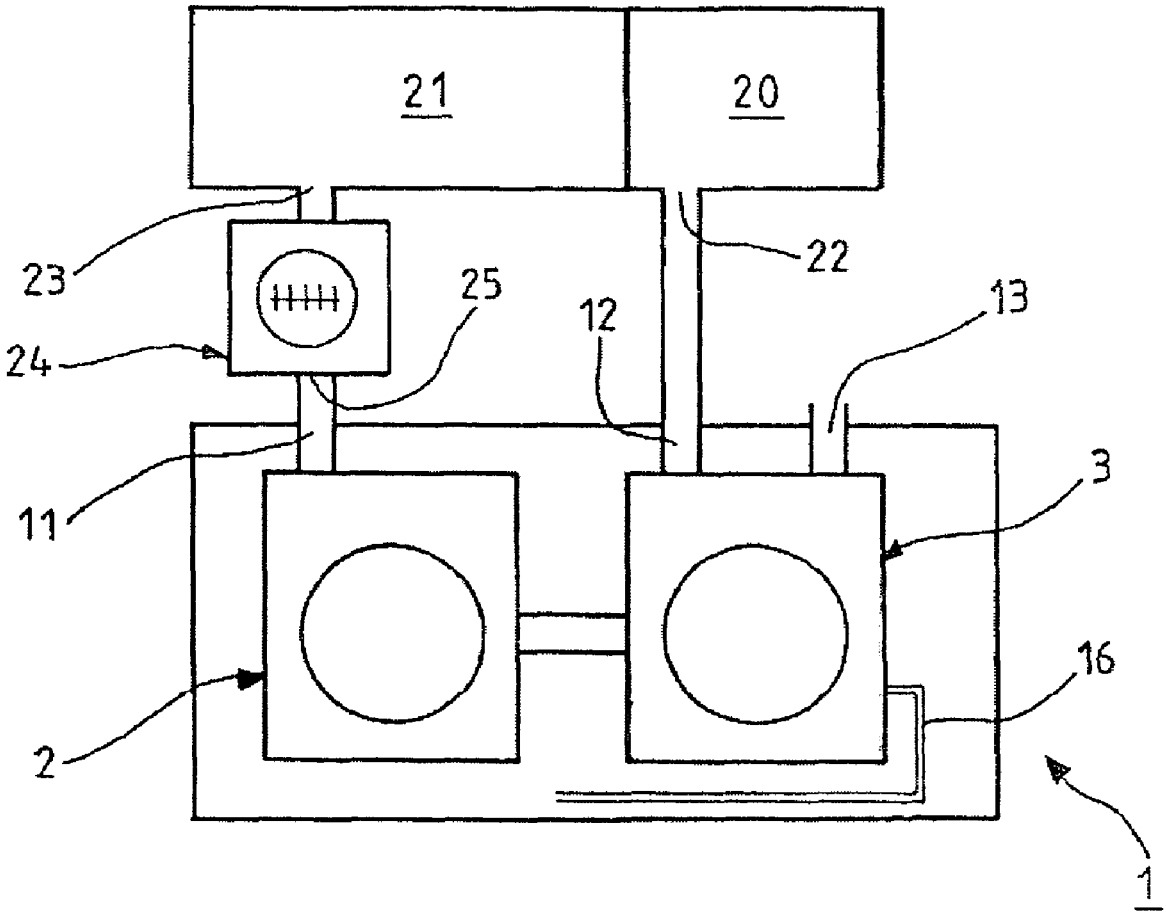
FIG. 2 is a diagram of an installation including the FIG. 1 pump.

The installation of the present invention shown in FIG. 2 has two chambers 20, 21. The outlet 22 from the first chamber 20 is connected to the admission inlet 12 of the "high pressure" stage 3 of the pump 1 of the invention that has the higher flow rate, i.e. that has the greater pumping volume. The outlet 23 from the following chamber 21 is connected to a turbomolecular pump 24 whose delivery outlet 25 is itself connected to the admission inlet 11 of the "low pressure" stage 2 of the pump 1 of the invention having the lower flow rate.

What is claimed is:

1. A multistage vacuum pump comprising at least a low pressure first stage and at least a high pressure second stage, one of said stages having at least one inlet for admitting gas to be pumped and at least one outlet, and another of said stages having at least one inlet and at least one outlet for exhausting pumped gas to an outside, said first and second stages communicating with each other to allow gas to pass from said first stage to said second stage, and wherein the first stage operates at a lower flow rate than the second stage.

2. The multistage pump according to claim 1, in which said first stage has a swept volume per cycle smaller than that of said second stage.

3. The multistage pump according to claim 1, in which said second stage sucks in gas coming from a chamber requiring a rough vacuum.

4. The multistage pump according to claim 1, in which said first stage sucks in gas coming from the outlet of a secondary pump.

5. The multistage pump according to claim 1, in which said first and second stages are physically interchanged.

6. The multistage pump according to claim 1, which is an oil-seal rotary vane positive-displacement pump.

7. The multistage pump according to claim 6, in which the oil is injected into said second stage having the greater flow rate.

8. The multistage pump according to claim 1, which is a positive-displacement pump selected from a diaphragm pump, a rotary piston pump, an oscillating piston pump, and a dynamic compression pump of the Roots type.

9. A vacuum installation including a multistage pump according to claim 1, further comprising at least one turbomolecular pump whose delivery outlet is connected to said multistage pump.

10. The installation according to claim 9, having at least two chambers and including a multistage pump in which a first chamber is connected to said multistage pump and a second chamber is connected to a turbomolecular pump whose delivery outlet is connected to said multistage pump.

11. The installation according to claim 10, in which the gas inlet of said first stage of low flow rate is connected to the delivery of the turbomolecular pump, and the gas inlet of said second stage of greater flow is connected to said first chamber.

12. The multistage pump according to claim 1, wherein the high pressure second stage includes two inlets, and wherein one inlet of the high pressure second stage is connected to an outlet of the low pressure first stage.

13. The multistage pump according to claim 1, wherein the low pressure first stage includes an inlet.

14. The multistage pump according to claim 1, wherein said first and second stages communicate with each other to allow gas to pass from said second stage to said first stage.

* * * * *